US012612908B2

(12) United States Patent
Yin et al.

(10) Patent No.: US 12,612,908 B2
(45) Date of Patent: Apr. 28, 2026

(54) PUMPING CONTROL METHOD AND APPARATUS, MATERIAL DISTRIBUTION METHOD AND APPARATUS AS WELL AS DISTRIBUTION DEVICE

(71) Applicant: ZOOMLION HEAVY INDUSTRY SCIENCE AND TECHNOLOGY CO., LTD., Hunan (CN)

(72) Inventors: Jun Yin, Hunan (CN); Zhongwei Zeng, Hunan (CN); Liang Wan, Hunan (CN); Liang Wu, Hunan (CN); Yibiao Nie, Hunan (CN)

(73) Assignee: ZOOMLION HEAVY INDUSTRY SCIENCE AND TECHNOLOGY CO., LTD., Hunan (CN)

( * ) Notice: Subject to any disclaimer, the term of this patent is extended or adjusted under 35 U.S.C. 154(b) by 1079 days.

(21) Appl. No.: 17/621,119

(22) PCT Filed: Nov. 9, 2020

(86) PCT No.: PCT/CN2020/127431
§ 371 (c)(1),
(2) Date: Dec. 20, 2021

(87) PCT Pub. No.: WO2022/032898
PCT Pub. Date: Feb. 17, 2022

(65) Prior Publication Data

US 2022/0381047 A1 Dec. 1, 2022

(30) Foreign Application Priority Data

Aug. 12, 2020 (CN) ..... 202010808872.6

(51) Int. Cl.
*F04B 49/20* (2006.01)
*F04B 15/02* (2006.01)
*F04B 49/06* (2006.01)

(52) U.S. Cl.
CPC ..... *F04B 49/20* (2013.01); *F04B 15/02* (2013.01); *F04B 49/065* (2013.01)

(58) Field of Classification Search
CPC .. F04B 1/02; F04B 15/02; F04B 47/00; F04B 49/12; F04B 49/16; F04B 49/20;
(Continued)

(56) References Cited

U.S. PATENT DOCUMENTS 5,106,272 A * 4/1992 Oakley ..... G01F 11/029 73/239
6,375,432 B1 4/2002 Krasny et al.
(Continued)

FOREIGN PATENT DOCUMENTS

CN 100406733 C 7/2008
CN 102493657 A 6/2012
(Continued)

*Primary Examiner* — Bryan M Lettman
*Assistant Examiner* — Chirag Jariwala
(74) *Attorney, Agent, or Firm* — Calfee, Halter & Griswold LLP

(57) ABSTRACT

The invention relates to the field of engineering machinery, and discloses a pumping control method and apparatus, a material distribution method and apparatus as well as a distribution device. The pumping control method includes: calculating an initialized pumping speed; controlling a distribution device to pump at the initialized pumping speed; and dynamically adjusting the pumping speed of the distribution device in real time according to a completed real-time distribution volume and real-time distribution time during the pumping of the distribution device until the real-time distribution volume is a desired distribution volume. Therefore, the accuracy of a final distribution volume is improved. The distribution method includes: controlling a distribution device to perform distribution at a to-be-distributed location in a preset distribution area; and after distribution at the to-be-distributed location is completed, determining a next
(Continued)

to-be-distributed location in the preset distribution area and performing distribution at the next to-be-distributed location until distribution at each to-be-distributed location in the preset distribution area is completed. Therefore, automatic distribution is achieved.

30 Claims, 7 Drawing Sheets

(58) Field of Classification Search
CPC ..... F04B 49/065; F04B 2201/0206; F04B 2201/0209; E21B 43/2607
See application file for complete search history.

(56) References Cited

U.S. PATENT DOCUMENTS

| | | | | |
|---|---|---|---|---|
| 12,006,926 | B1 * | 6/2024 | Barnett, Jr. ..... | F04B 1/053 |
| 2007/0154319 | A1 * | 7/2007 | Stiles, Jr. ..... | F04B 49/065 417/42 |
| 2019/0055937 | A1 * | 2/2019 | Parmeshwar ..... | F04B 9/045 |

FOREIGN PATENT DOCUMENTS

| | | | |
|---|---|---|---|
| CN | 104832412 | A | 8/2015 |
| CN | 104929787 | A | 9/2015 |
| CN | 105317667 | A | 2/2016 |
| CN | 105500514 | A | 4/2016 |
| CN | 105626500 | A | 6/2016 |
| CN | 110284720 | A | 9/2019 |
| CN | 111058637 | A | 4/2020 |
| JP | 2012066888 | A | 4/2012 |
| WO | 02084117 | A2 | 10/2002 |

* cited by examiner

| Serial number | Location | Volume | Reference sign | Time |
|---|---|---|---|---|
| 1 | Coordinate X: XXX | 5 | C30 | 3M |
| | Coordinate Y: XXX | 5 | 30 | 3M |
| | Coordinate Z: XXX | XXX | XXX | XXX |
| 2 | ... | ... | ... | ... |
Fig. 9
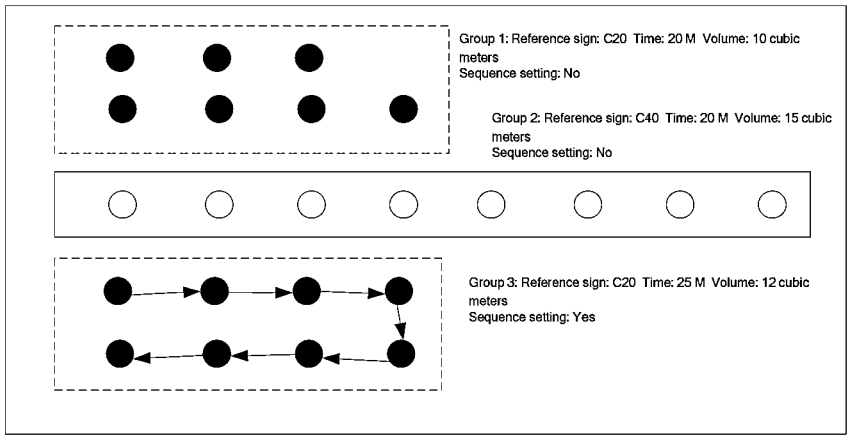
Fig. 10
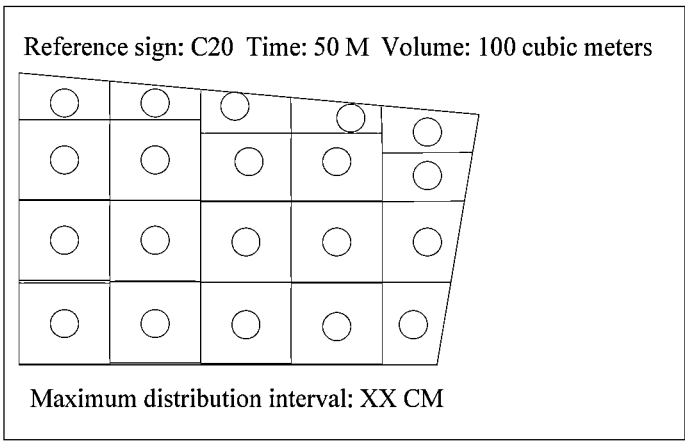
Fig. 11

PUMPING CONTROL METHOD AND APPARATUS, MATERIAL DISTRIBUTION METHOD AND APPARATUS AS WELL AS DISTRIBUTION DEVICE

CROSS-REFERENCE TO RELATED APPLICATIONS

This application is a 371 of PCT Application No. PCT/CN2020/127431 filed on Nov. 9, 2020, which claims the benefit of Chinese Patent Application 202010808872.6 filed on Aug. 12, 2020, the contents of which are incorporated herein by reference.

FIELD OF THE INVENTION

The present invention relates to the field of engineering machinery, in particular to a distribution control method and apparatus, a material distribution method and apparatus as well as a distribution device.

BACKGROUND OF THE INVENTION

Concrete distribution device, such as a pump truck and a distribution machines, is a commonly used engineering machinery for transporting concrete through a delivery pipe on a boom to a predetermined location.

An operator is required for the concrete distribution apparatus, needs to constantly operate the boom and pumping to deliver concrete to a designated location according to the requirements of a construction side.

However, due to the long single concrete construction time, the frequent operation and the harsh natural environment, the operator has very long working time and extremely high labour intensity. Therefore, how to achieve an automatic distribution according to the construction requirements is an urgent need to be addressed by the industry.

Two technical solutions are disclosed in the prior art. In a first technical solution, as shown in FIG. 1, a pouring location is preset, and concrete is distributed in a pouring area corresponding to the preset pouring location, and whether distribution at the preset pouring location is completed is determined based on whether a starting duration of a pumping system reaches a preset duration corresponding to the preset pouring location. In the first technical solution, concrete pouring work is completed automatically without manual involvement. A second technical solution discloses a distribution robot that implements a multi-path distribution of a boom end, such as distribution in a straight-line mode, an arc-line mode, a grid-line mode, and a broken-line mode.

In implementation of the present invention, the inventor finds that there are at least following problems in the prior art. The first technical solution suffers from the following drawbacks: 1) a pouring site is preset in advance, and cannot be dynamically adjusted according to the construction demands, a current pouring site of the device, reference signs of concrete, etc., and therefore, adaptation to the actual complex construction demands cannot be achieved, for example, there may be a possibility that concrete C20 may be poured to a pouring site of concrete C30, resulting in severe engineering quality; 2) a determination of a pumping volume by the only consideration of pumping time at the pouring site causes a very large error, because an actual pumping volume is related to many factors such as a number of pumping times, piston strokes and suction conditions, and it cannot be guaranteed that the distribution volume of each pouring site meets the construction requirements; and 3) there is no consideration of the movement track of a boom leaving for a next pouring site, and pause or avoidance of the boom in case of the presence of obstacles and other conditions. Based on the above drawbacks, the first technical solution can only be used for idealized construction scenarios and cannot be practically promoted. The second technical solution suffers from the following drawbacks: only various distribution paths are proposed, but there is no illustration about the cooperation with pumping to ensure that the construction requirements are satisfied when concrete is poured during the boom movement process, and the basis of selection of distribution paths is not proposed.

SUMMARY OF THE INVENTION

The objectives of the present invention are to provide a pumping control method and apparatus, a material distribution method and apparatus and a distribution device, solving or at least partly solving the above technical problems.

In order to achieve the above objectives, in one aspect, an embodiment of the present invention provides a pumping control method, including: calculating an initialized pumping speed based on a desired distribution volume and desired distribution time for a to-be-distributed location; controlling a distribution device to pump at the initialized pumping speed; and dynamically adjusting the pumping speed of the distribution device in real time according to a completed real-time distribution volume and real-time distribution time during the pumping of the distribution device until the real-time distribution volume is the desired distribution volume.

Preferably, wherein the real-time distribution volume is determined according to an area of a pumping concrete cylinder and an effective stroke of a piston in pumping at each time.

Preferably, wherein the real-time distribution volume is determined by: multiplying a number of pumping times, the area of the pumping concrete cylinder, and an average value of the effective stroke of the piston in pumping at each time; or determining a distribution volume in pumping at each time based on the area of the pumping concrete cylinder and the effective stroke of the piston in pumping at each time, and accumulating the distribution volume in pumping at each time.

Preferably, wherein the effective stroke of the piston in pumping at each time is determined based on: time when the piston starts to move in pumping at this time, time when a pumping pressure reaches a stable value, time when pumping is completed, and a theoretical stroke of the piston.

Preferably, wherein the effective stroke of the piston in pumping at each time is determined based on: an actual stroke of the piston from the start of pumping to the pumping pressure reaching the stable value during pumping at this time, an actual stroke from the pumping pressure reaching the stable value to the end of pumping during pumping at this time, and a preset suction coefficient.

Preferably, wherein the real-time distribution volume is determined according to a real-time discharge volume of an agitator truck for providing a material for the distribution device.

In addition, in another aspect, an embodiment of the present invention provides a material distribution method, which includes: controlling a distribution device to perform distribution at a to-be-distributed location in a preset distribution area; and after distribution at the to-be-distributed location is completed, determining a next to-be-distributed location in the preset distribution area and performing distribution at the next to-be-distributed location, until distribution at each to-be-distributed location in the preset distribution area is completed, wherein a material required to be distributed at the next to-be-distributed location and a material currently provided by the distribution device are concrete with the same reference sign, and distribution is performed at each to-be-distributed location in the preset distribution area by the above pumping control method.

Preferably, wherein the determining the next to-be-distributed location in the preset distribution area comprising: determining a to-be-distributed location in the preset distribution area based on a preset distribution path planning rule; judging whether a reference sign of desired concrete at the determined to-be-distributed location is the same as a reference sign of concrete currently provided by the distribution device; and in the case that the reference sign of the desired concrete at the determined to-be-distributed location is different from the reference sign of the concrete provided by the distribution device, re-determining a to-be-distributed location in the preset distribution area based on the preset distribution path planning rule, until the reference sign of the desired concrete at the determined to-be-distributed location is the same as the reference sign of the concrete currently provided by the distribution device, wherein the determined to-be-distributed location is the next to-be-distributed location.

Preferably, wherein the preset distribution path planning rule is: such that a path for distribution completed at remaining to-be-distributed locations in the preset distribution area is shortest; or a preset sequence of the to-be-distributed locations in the preset distribution area.

Preferably, wherein a material required to be distributed in the preset distribution area is concrete with the same reference sign, and the determining the next to-be-distributed location in the preset distribution area comprises determining the next to-be-distributed location according to the following formula:

$BSR_{i+1}=BSR_i+\lambda\cdot\vec{\theta}\cdot\beta$, wherein $BSR_{i+1}$ is the next to-be-distributed location, $BSR_iBSR_i$ is a current to-be-distributed location, $\lambda$ is a first preset proportion coefficient, $\beta$ is a real-time opening degree of a boom switch of the distribution device, and $\vec{\theta}$ is a direction of the boom switch.

Preferably, wherein a material required to be distributed in the preset distribution area is concrete with the same reference sign, when the distribution device is controlled to perform distribution at one to-be-distributed location in the preset distribution area, desired distribution time for this to-be-distributed location is an opening duration of a pumping switch of the distribution device, and a desired distribution volume at this to-be-distributed location is determined based on the real-time opening degree of the pumping switch, time corresponding to opening and closing in real time, and a second preset proportion coefficient.

Preferably, after determining the next to-be-distributed location in the preset distribution area, the distribution method further comprising: judging whether a current boom end location of the distribution device is the same as the next to-be-distributed location; planning a next boom end location in the case that the current boom end location is different from the next to-be-distributed location; judging whether there is an obstacle at the next boom end location; judging whether the obstacle is a person in the case that there is the obstacle at the next boom end location; in the case that the obstacle is a person, controlling a boom to stop movement until the obstacle is not a person or the next boom end location is clear of an obstacle; and in the case that the obstacle is not a person, avoiding the obstacle, re-planning a next boom end location until a boom end of the distribution device moves to the next to-be-distributed location such that the distribution device performs distribution at the next to-be-distributed location, wherein the planning the next boom end location and re-planning the next boom end location satisfy any one of the following conditions: a distance from the next to-be-distributed location is shortest and a number of movement sections of the boom of the distribution device is least.

Preferably, wherein the to-be-distributed location in the preset distribution area is planned based on at least one of: a distance between the adjacent to-be-distributed locations is less than or equal to a preset distribution interval, and the distance between the adjacent to-be-distributed locations is less than or equal to a distribution diameter of an end hose of the distribution device.

Accordingly, in another aspect, an embodiment of the present invention also provides a pumping control apparatus, comprising: an initialized pumping speed calculation module configured to calculate an initialized pumping speed according to a desired distribution volume and desired distribution time for a to-be-distributed location; and a pumping control module configured to control a distribution device to pump at the initialized pumping speed and dynamically adjust the pumping speed of the distribution device in real time according to a completed real-time distribution volume and real-time distribution time during the pumping of the distribution device until the real-time distribution volume is the desired distribution volume.

Preferably, wherein the real-time distribution volume is determined according to an area of a pumping concrete cylinder and an effective stroke of a piston in pumping at each time.

Preferably, wherein the real-time distribution volume is determined by: multiplying a number of pumping times, the area of the pumping concrete cylinder, and an average value of the effective stroke of the piston in pumping at each time; or determining a distribution volume in pumping at each time based on the area of the pumping concrete cylinder and the effective stroke of the piston in pumping at each time, and accumulating the distribution volume in pumping at each time.

Preferably, wherein the effective stroke of the piston in pumping at each time is determined based on: time when the piston starts to move in pumping at this time, time when a pumping pressure reaches a stable value, time when pumping is completed, and a theoretical stroke of the piston.

Preferably, wherein the effective stroke of the piston in pumping at each time is determined based on: an actual stroke of the piston from the start of pumping to the pumping pressure reaching the stable value during pumping at this time, an actual stroke from the pumping pressure reaching the stable value to the end of pumping during pumping at this time, and a preset suction coefficient.

Preferably, the real-time distribution volume is determined according to a real-time discharge volume of an agitator truck for providing a material for the distribution device.

Accordingly, In another aspect, an embodiment of the present invention also provides a material distribution apparatus, comprising: a distribution control module configured to control a distribution device to perform distribution at a to-be-distributed location in a preset distribution area, and after distribution at the to-be-distributed location is completed, determine a next to-be-distributed location in the preset distribution area and perform distribution at the next to-be-distributed location, until distribution at each to-be-distributed location in the preset distribution area is completed, wherein a material required to be distributed in the next to-be-distributed location and a material currently provided by the distribution device are concrete with the same reference sign, and distribution is performed at each to-be-distributed location in the preset distribution area by the above pumping control method.

Preferably, wherein the determining the next to-be-distributed location in the preset distribution area comprising: determining a to-be-distributed location in the preset distribution area based on a preset distribution path planning rule; judging whether a reference sign of desired concrete at the determined to-be-distributed location is the same as a reference sign of concrete currently provided by the distribution device; and in the case that the reference sign of the desired concrete at the determined to-be-distributed location is different from the reference sign of the concrete provided by the distribution device, re-determining a to-be-distributed location in the preset distribution area based on the preset distribution path planning rule, until the reference sign of the desired concrete at the determined to-be-distributed location is the same as the reference sign of the concrete currently provided by the distribution device, wherein the determined to-be-distributed location is the next to-be-distributed location.

Preferably, wherein the preset distribution path planning rule is: such that a path for distribution completed at remaining to-be-distributed locations in the preset distribution area is shortest; or a preset sequence of the to-be-distributed locations in the preset distribution area.

Preferably, a material required to be distributed in the preset distribution area is concrete with the same reference sign, and the determining the next to-be-distributed location in the preset distribution area comprises determining the next to-be-distributed location according to the following formula:

$BSR_{i+1}=BSR_i+\lambda\cdot\vec{\theta}\cdot\beta$, wherein $BSR_{i+1}$ is the next to-be-distributed location, $BSR_i$ is a current to-be-distributed location, $\lambda$ is a first preset proportion coefficient, $\beta$ is a real-time opening degree of a boom switch of the distribution device, and $\vec{\theta}$ is a direction of the boom switch.

Preferably, wherein a material required to be distributed in the preset distribution area is concrete with the same reference sign, when the distribution device is controlled to perform distribution at one to-be-distributed location in the preset distribution area, desired distribution time for this to-be-distributed location is an opening duration of a pumping switch of the distribution device, and a desired distribution volume at this to-be-distributed location is determined based on the real-time opening degree of the pumping switch, time corresponding to opening and closing in real time, and a second preset proportion coefficient.

Preferably, after determining the next to-be-distributed location in the preset distribution area, the distribution apparatus further comprising: a judgment module configured to judge whether a current boom end location of the distribution device is the same as the next to-be-distributed location after the next to-be-distributed location in the preset distribution area is determined; a planning module configured to plan a next boom end location in the case that the current boom end location is different from the next to-be-distributed location; the judgment module further configured to: judge whether there is an obstacle at the next boom end location, and judge whether the obstacle is a person in the case that there is the obstacle at the next boom end location; the distribution apparatus further comprising: in the case that the obstacle is a person, controlling a boom to stop movement until the obstacle is not a person or the next boom end location is clear of an obstacle; and the planning module is further configured to: in the case that the obstacle is not a person, avoid the obstacle, re-planning a next boom end location until a boom end of the distribution device moves to the next to-be-distributed location such that the distribution device performs distribution at the next to-be-distributed location, wherein the planning the next boom end location and re-planning the next boom end location satisfy any one of the following conditions: a distance from the next to-be-distributed location is shortest and a number of movement sections of the boom of the distribution device is least.

Preferably, wherein the to-be-distributed location in the preset distribution area is planned based on at least one of: a distance between the adjacent to-be-distributed locations is less than or equal to a preset distribution interval, and the distance between the adjacent to-be-distributed locations is less than or equal to a distribution diameter of an end hose of the distribution device.

In addition, in yet another aspect, an embodiment of the present invention provides a distribution device including: the above pumping control apparatus; and/or the above distribution apparatus.

By one embodiment of the above technical solution that during pumping, the pumping speed of the distribution device is dynamically adjusted according to the real-time distribution volume and the real-time distribution time until the real-time distribution volume is the desired distribution volume, it is realized that a final distribution volume satisfies the construction requirements and reaches the desired distribution volume, the problem of incapability of guaranteeing that the distribution volume satisfies the construction requirements due to a large error caused by excessive or insufficient distribution resulted from a fixed pumping speed due to the determination of the pumping volume by the only consideration of the pumping time can be solved, and the accuracy of the final distribution volume is improved. According to another embodiment of the above solution, the distribution can be realized without manual involvement and an automatic distribution is realized.

Other features and advantages of the present invention will be illustrated in the following section of specific embodiments.

BRIEF DESCRIPTION OF DRAWINGS

The accompanying drawings are used to provide a further understanding of the present invention and constitute a part of this specification and, together with the following specific embodiments, serve to explain the present invention, but do not constitute a limitation to the present invention. In the drawings:

FIG. 9 is a schematic diagram of setting of a human-machine interface provided by another embodiment of the present invention;

FIG. 10 is a schematic diagram of setup of a human-machine interface provided by another embodiment of the present invention;

FIG. 11 is a schematic diagram of setup of a human-machine interface provided by another embodiment of the present invention;

Figure 1:
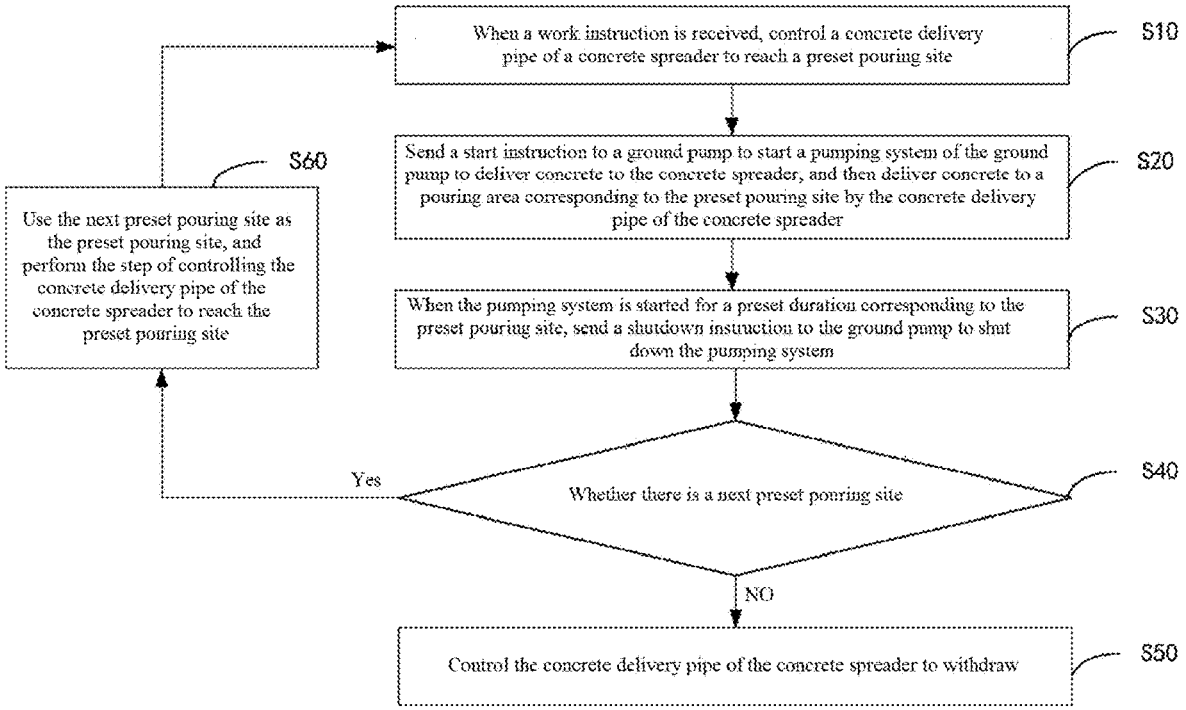
Fig. 1 Prior Art
FIG. 1 is a logic schematic diagram of a common precision control method for an intelligent distribution machine in the prior art.

| Description of Reference Numerals | |
|---|---|
| 1-demand unit | 2-detection unit |
| 3-pumping control unit | 4-boom control unit |
| 5-planning unit | 6-initialized pumping speed calculation module |
| 7-pumping control module | |

DETAILED DESCRIPTION OF THE EMBODIMENTS

Specific embodiments of the present invention are described in detail below in conjunction with the accompanying drawings. It should be understood that the specific embodiments described herein are intended to illustrate and explain the present invention only, and are not intended to limit the present invention.

In an aspect, an embodiment of the present invention provides a pumping control method.

Figure 2:
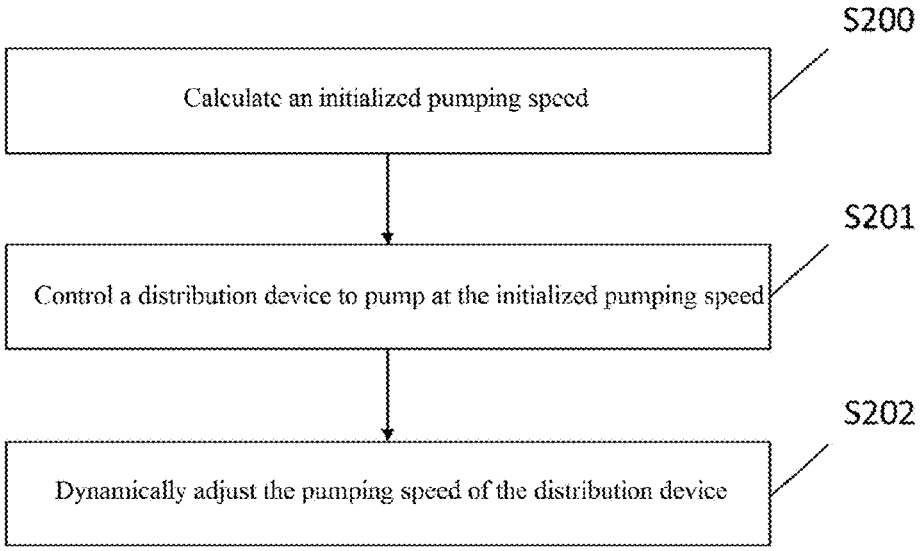
FIG. 2 is a flow diagram of a pumping control method provided by an embodiment of the present invention.

FIG. 2 is a flow diagram of a pumping control method provided by an embodiment of the present invention. As shown in FIG. 2, the pumping control method includes the following content.

In step S200, an initialized pumping speed is calculated according to a desired distribution volume and desired distribution time for a to-be-distributed location. A distribution location is a location where a material is required to be distributed, wherein the material that is required to be distributed may be concrete. The desired distribution volume and the desired distribution time may be a distribution volume and distribution time set according to actual demands, and may be determined according to specific circumstances. The initialized pumping speed may be calculated by dividing the desired distribution volume by the desired distribution time, specifically, the initialized pumping speed is $PV_{t(i)}=(PCR_i)/PTR_i$, where $PCR_i$ is the desired distribution volume and $PTR_i$ is the desired distribution time.

In step S201, a distribution device is controlled to pump at the initialized pumping speed.

In step S202, during pumping of the distribution device, the pumping speed of the distribution device is dynamically adjusted in real time according to a completed real-time distribution volume and real-time distribution time until the real-time distribution volume is the desired distribution volume. The pumping speed may be dynamically adjusted according to the desired distribution volume, the desired distribution time, the real-time distribution volume, and the real-time distribution time. Specifically, the adjustment can be made with the following formula: an adjusted pumping speed $PV_{t(i)}=(PCR_i-PC(i))/(PTR_i-PT(i))$, wherein PC(i) is the real-time distribution volume and PT(i) is the real-time distribution time.

By the above technical solution that during pumping, the pumping speed of the distribution device is dynamically adjusted according to the real-time distribution volume and the real-time distribution time until the real-time distribution volume is the desired distribution volume, it is realized that the final distribution volume satisfies the construction requirements and reaches the desired distribution volume, the problem of incapability of guaranteeing that the distribution volume satisfies the construction requirements due to a large error caused by excessive or insufficient distribution resulted from a fixed pumping speed due to the determination of the pumping volume by the only consideration of the pumping time can be solved, and the accuracy of the final distribution volume is improved.

Preferably, in the embodiments of the present invention, there are many methods to determine the real-time distribution volume, for example, the real-time distribution volume can be determined based on an area of a pumping concrete cylinder and an effective strokes of a piston in pumping at each time. Specifically, the real-time distribution volume may be determined taking into account a number of pumping times, the area of the pumping concrete cylinder and an average value of the effective stroke of the piston in pumping at each time, wherein the effective stroke of the piston is a stroke of the piston under the circumstance that the concrete cylinder of the distribution device is fully filled. Specifically, the real-time distribution volume may be determined by multiplying the number of pumping times, the area of the pumping concrete cylinder area, and the average value of the effective stroke of the piston in pumping at each time, wherein the number of the pumping times is a total number of pumping times up to the time when the real-time distribution volume is calculated. In addition, there are many methods to calculate the average value of the effective strokes of the piston. Preferably, several pumping times may be selected from the number of pumping times up to the time when the real-time distribution volume is calculated, and the average value of the effective strokes of the piston corresponding to the selected several pumping times is calculated. For example, for a certain determination of a real-time volume, a total number of pumping times is 100 up to the time when the real-time volume is calculated, one effective stroke for calculation of the average value is optionally selected every 10 pumping times, and finally the average value of all selected effective strokes of the piston is calculated. In this way, calculation can be simplified, calculation power is saved. In addition, the real-time distribution volume may also be determined by an accumulation of the distribution volume in pumping at each time. Specifically, the distribution volume in pumping at each time is determined based on the area of the pumping concrete cylinder and the effective stroke of the piston in pumping at each time, and then the real-time distribution volume is determined by the accumulation of the distribution volume in pumping at each time, wherein the single distribution volume in the accumulation is the distribution volume corresponding to the pumping at each time among the total number of pumping times up to the time when the real-time distribution volume is calculated at each time. As pumping proceeds, the number of pumping times increases, and the accumulative distribution volume also increases in calculation of the real-time distribution volume. It should be noted that in the embodiments of the present invention, in addition to the method for calculating the real-time distribution volume in the above example, other methods for calculating the real-time distribution volume in the prior art may also be adopted.

In addition, there are many methods to calculate the effective stroke of the piston in the embodiment of the present invention.

Preferably, in the embodiment of the present invention, the effective stroke of the piston in pumping at each time is determined based on time when the piston in pumping at this time starts to move, time when the pumping pressure reaches a stable value, time when pumping is completed, and a theoretical stroke of the piston.

Figure 3:
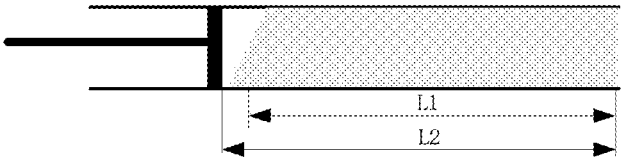
FIG. 3 is a schematic diagram of a stroke provided by another embodiment of the present invention.

How to determine the effective stroke will be described below by taking the material being concrete as an example. As shown in FIG. 3, the theoretical stroke of a concrete cylinder is L2, wherein the theoretical stroke L2 may be an inherent structural dimension of the concrete cylinder of each distribution device, or may also be a preset stroke of the piston, and the direction changes when the preset stroke is reached. However, during pumping at each time, the concrete cylinder has a blank portion which is not filled with concrete, the effective stroke is defined as a movement distance for the piston to actually compact the concrete, that is, the effective stroke of the piston is the stroke of the piston under the circumstance that the concrete cylinder of the distribution device is fully filled, For L1 as shown in FIG. 3, a grey portion represents the material, the material represented by a grey triangle portion does fully fill the concrete cylinder, the material represented by the grey triangle portion is equivalent to filling the concrete cylinder, together with the material represented by the grey portion for filling the concrete cylinder to obtain the effective stroke of the piston under the circumstance that the concrete cylinder is fully filled. Thus, it can be seen that the effective stroke L1 is smaller than L2 based on FIG. 3.

Figure 4:
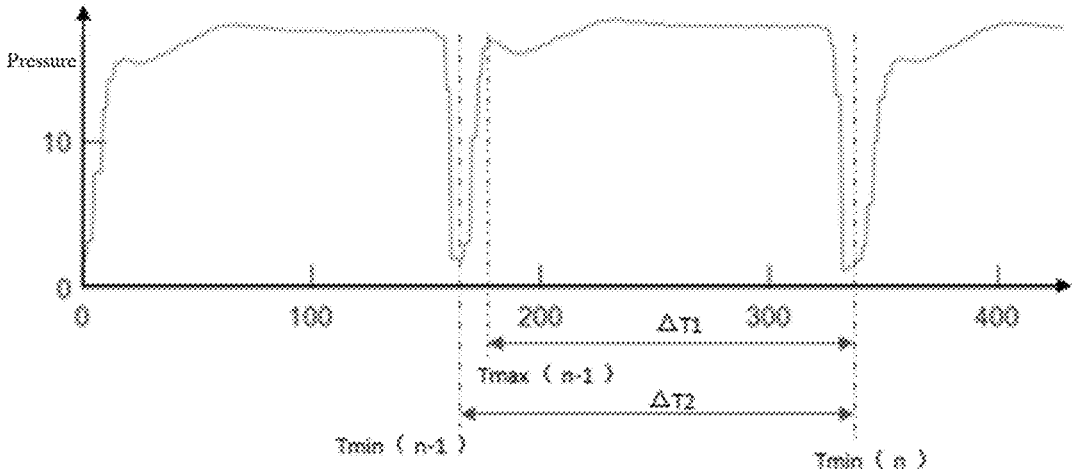
FIG. 4 is a pumping pressure graph provided by another embodiment of the present invention.

According to a pumping pressure (i.e., the pressure generated by pressing concrete through the piston) curve, as shown in FIG. 4, the effective stroke can be calculated.

In a single pumping cycle, the piston starts moving from Tmin(n−1) until the pumping pressure reaches the stable value at Tmax(n−1), i.e., the movement time period from Tmax(n−1) to Tmin(n−1) indicates the process of compacting concrete, i.e., it can be seen that no concrete (less concrete) exists in this movement distance, Tmin(n) represents the completion time of pumping at this time, and thus the effective stroke calculation formula is: L1=(Tmin(n)−Tmax(n−1))/(Tmin(n)−Tmin(n−1))*L2, wherein L1 is the effective stroke and L2 is the theoretical stroke.

Preferably, in the embodiment of the present invention, a preset suction coefficient may also be taken into account in the effective stroke to make the calculated effective stroke more accurate. Specifically, for L1=((Tmin(n)−Tmax(n−1))+(Tmax(n−1)−Tmin(n−1))*k)/(Tmin(n)−Tmin(n−1))*L2, k is a preset suction coefficient. Preferably, k may be about 0.5, for example, between 0.4-0.6.

Preferably, in the embodiment of the present invention, the effective stroke of the piston in pumping at each time is determined based on an actual stroke of the piston from the start of pumping to the pumping pressure reaching the stable value during pumping at each time, an actual stroke of the piston from the pumping pressure reaching the stable value to the end of pumping, and the preset suction coefficient.

Specifically, a cylinder piston stroke detection apparatus is added, for example, a magnetostrictive sensor, in combination with the pumping pressure, can directly detect the actual stroke of the piston from the start of pumping to the pumping pressure reaching the stable value and the actual stroke of the piston from the pump pressure reaching the stable value to the end of pumping.

Figure 5:
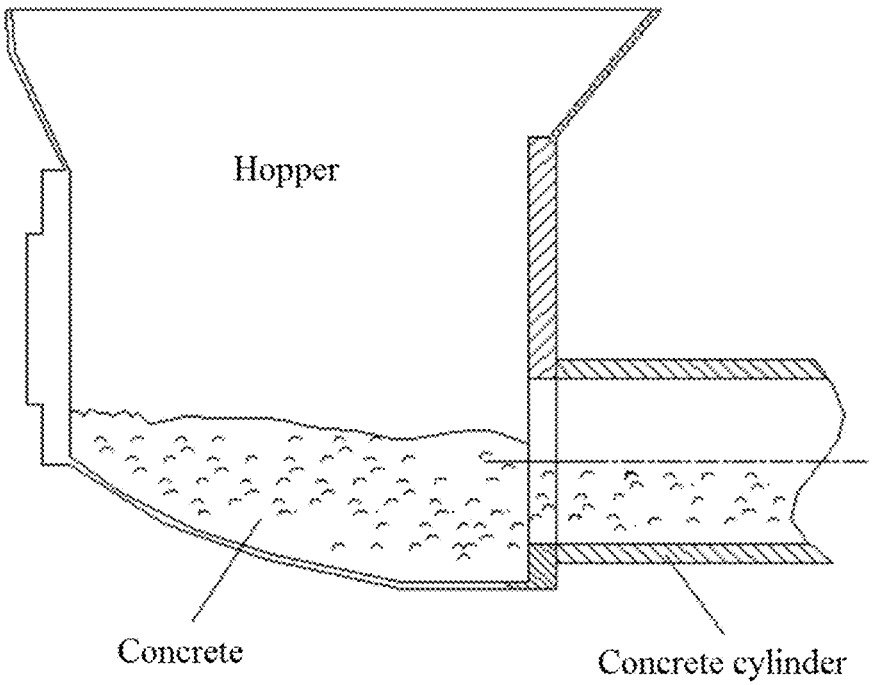
FIG. 5 is a schematic diagram of suction in a pumping process.

The effective stroke of the piston in pumping at each time is calculated as follows: a product of the actual stroke of the piston from the start of pumping to the pump pressure reaching the stable value and the preset suction coefficient is calculated, plus the actual stroke of the piston from the pumping pressure reaching the stable value to the end of pumping. As shown in FIG. 5, a suction amount (a filling degree) of a pumping device in a pumping process is mainly influenced by following three factors: 1) it depends on a concrete amount (a material level) inside a hopper, when the level is too low, a part of the concrete cylinder cannot suck anything when in suction and thus cannot give full play to the suction capability, as shown in the figure above; 2) the suction amount is also related to the fluidity of concrete, and good fluidity can produce a large suction amount; and 3) the suction amount is related to the homogeneity of concrete itself, and good homogeneity, i.e., less gaps between concrete aggregates distributed uniformly, can produce a large suction amount. A process between the start of pumping to a stable point of the pumping pressure truly reflects a process from suction of concrete to compaction of concrete, and therefore, the degree of filling of the material in the pumping process of the concrete cylinder can be reflected more accurately by calculating the product of the actual stroke of the piston from the start of pumping to the pumping pressure reaching the stable value and the preset suction coefficient. In the prior art, a solution the piston stroke from the start of pumping to the end of pumping is multiplied by the suction coefficient does not accurately reflect the degree of filling of the material, because inconsistency of piston strokes from the start of pumping to the end of pumping during pumping at each time is primarily affected by a leakage amount of hydraulic oil between a piston of the pumping cylinder and a cylinder tube, and is independent of the degree of filling of the material during pumping.

Figure 6:
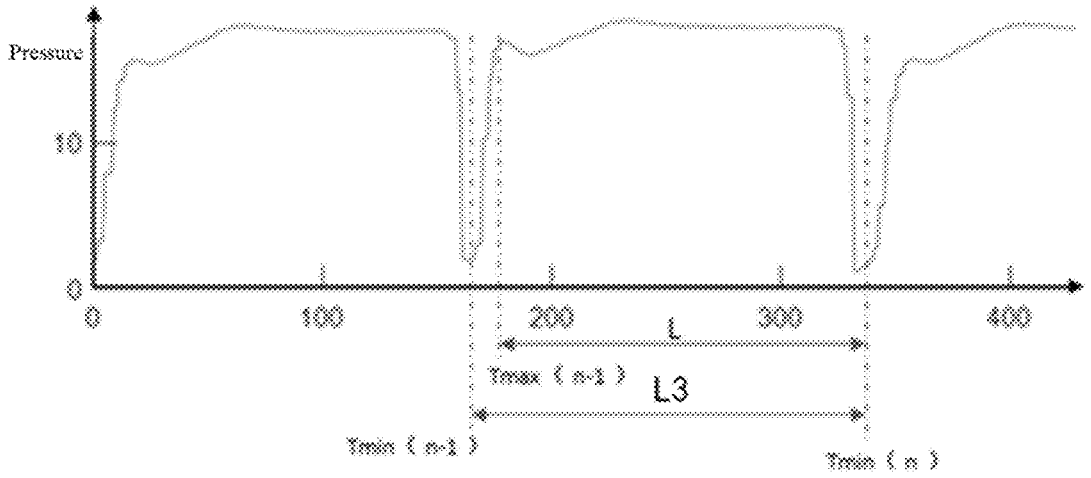
FIG. 6 is a pumping pressure graph provided by another embodiment of the present invention.

Furthermore, the actual stroke of the piston from the start of pumping to the pumping pressure reaching the stable value can be obtained by subtracting the actual stroke of the piston from the pumping pressure reaching the stable value to the end of pumping from the actual stroke of the piston from the start of pumping to the end of pumping, The effective stroke of the piston in pumping at each time can then be obtained with the actual stroke of the piston from the start to the end of the pumping, the actual stroke of the piston from the pumping pressure reaching the stable value to the end of pumping, and the preset suction coefficient, wherein the actual stroke can be obtained by direct detection. For example, as shown in FIG. 6, an actual stroke L from Tmax(n−1) to Tmin(n), an actual stroke L3 from Tmin(n−1) to Tmin(n) can be detected directly, and an effective stroke is L1=L+(L3−L)*k1, wherein k1 is a preset suction coefficient. Preferably, k1 may be about 0.5, for example between 0.4 and 0.6. In addition, the actual stroke of the piston from the pumping pressure reaching the stable value to the end of pumping can be obtained by subtracting the actual stroke of the piston from the start of the pumping to the pumping pressure reaching the stable value from the actual stroke of the piston from the start of pumping to the end of pumping, and the effective stroke of the piston in pumping at each time can then be obtained by the actual stroke of the piston from the start to the end of pumping, the actual stroke of the piston from the start of pumping to the pumping pressure reaching the stable value, and the preset suction coefficient.

Preferably, in the embodiment of the present invention, the real-time distribution volume may also be determined according to a real-time discharge volume of an agitator truck for providing the material for the distribution device. Specifically, when a certain distribution device is provided with the material by the same agitator truck all the time, a real-time discharge volume of the agitator truck is the real-time distribution volume; and when a certain distribution device is provided with the material by a plurality of agitator trucks during pumping, the real-time distribution volume is a total discharge volume of the agitator trucks that have completed the material providing plus a real-time discharge volume of the agitator truck that is providing the material. After the determination of the real-time discharge volume or the real-time discharge volume and the total discharge volume of the agitator truck, the determined data may be transmitted by wireless communication mode to a apparatus performing the pumping control method described in the embodiment of the present invention such that the apparatus receives the determined data and dynamically adjusts the pumping speed of the distribution device according to the received data.

How to determine the real-time discharge volume of the agitator truck that is providing material to the distribution device will be introduced below. The real-time discharge volume of the agitator truck may be determined by arranging one or more weighing sensors at a part for supporting an agitator tank on the agitator truck. It can be seen from the density, volume, and weight relationships that the weight of the agitator tank measured by the weighing sensors and the discharge volume of the agitator truck possess a one-to-one corresponding relationship which is a linear proportion relationship, wherein a specific proportion can be obtained experimentally. A real-time discharge volume that has been finished at a certain time is calculated by an initial weight measured by the weighing sensors when the material in the agitator tank is not discharged minus a weight of the agitator tank at that time, in combination with the corresponding relationship between the weight of the agitator tank and the discharge volume of the agitator truck. In addition, it should be noted that the total discharge volume of the agitator truck that have finished the material providing can also be determined according to the above content, and the total discharge volume is calculated by the initial weight of the agitator tank measured by the weighting sensors when the material is not discharged minus the weight of the agitator tank when the agitator truck has finished the material providing, in combination with the corresponding relationship between the weight of the agitator tank and the discharge volume of the agitator truck. In addition, it should be noted that other solutions for the calculation of the discharge volume of the agitator truck in the prior art can also be adapted to the present invention.

Furthermore, in another aspect, an embodiment of the present invention provides a material distribution method.

Figure 7:
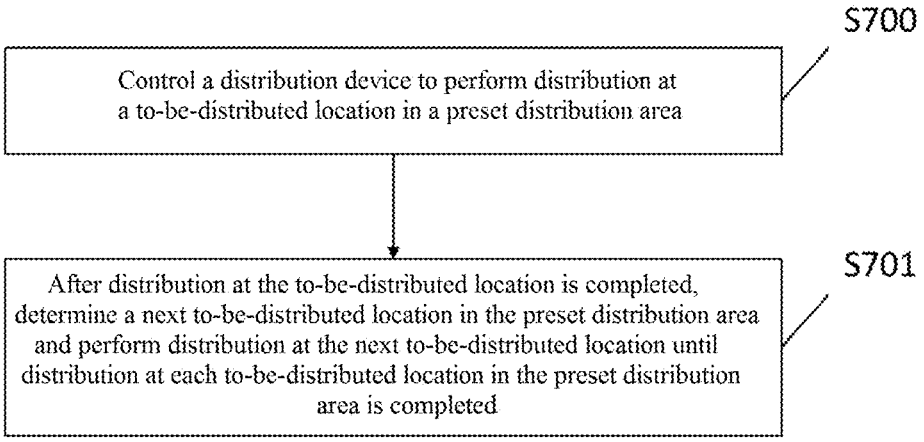
FIG. 7 is a flow diagram of a material distribution method provided by another embodiment of the present invention.

FIG. 7 is a material distribution method provided by another embodiment of the present invention. As shown in FIG. 7, the distribution method includes the following steps.

In step S700, a distribution device is controlled to perform distribution at a to-be-distributed location in a preset distribution area.

In step S701, after distribution is finished at the to-be-distributed location, a next to-be-distributed location in the preset distribution area is determined, and distribution is performed at the next to-be-distributed location, until distribution at each to-be-distributed location in the preset distribution area is completed, wherein a material required to be distributed at the next to-be-distributed location and a material currently provided by the distribution device are concrete with the same reference sign, distribution is performed at each to-be-distributed location in the preset distribution area by the pumping control method in the above embodiment.

With the above technical solution, the distribution can be realized without manual involvement and an automatic distribution is realized.

Preferably, in the embodiment of the present invention, the step that the next to-be-distributed location in the preset distribution area is determined includes determining a to-be-distributed location in the preset distribution area according to a preset distribution path planning rule; judging whether a reference sign of desired concrete at the determined to-be-distributed location is the same as a reference sign of concrete currently provided by the distribution device; and in the case that the reference sign of the desired concrete at the determined to-be-distributed location is different from the reference sign of the concrete provided by the distribution device, re-determining a to-be-distributed location in the preset distribution area based on the preset distribution path planning rule, until the reference sign of the desired concrete at the determined to-be-distributed location is the same as the reference sign of the concrete currently provided by the distribution device, wherein the determined to-be-distributed location is the next to-be-distributed location. Specifically, when the next to-be-distributed location is determined, firstly, one to-be-distributed location in the preset distribution area is determined based on the preset distribution path planning rule, the determined to-be-distributed location may be the next to-be-distributed location, or may also not be the next to-be-distributed location, and whether the reference sign of the desired concrete required to be distributed at the determined to-be-distributed location is the same as the reference sign of the concrete currently provided by the distribution device needs to be determined. If the reference signs are the same, the determined to-be-distributed location is the next to-be-distributed location; if the reference signs are different, a to-be-distributed location needs to be re-determined according to the preset distribution path planning rule, and whether a reference sign of desired concrete of the re-determined to-be-distributed location is the same as the reference sign of the concrete currently provided by the distribution device is determined, if so, the re-determined to-be-distributed location is the next to-be-distribution location, and otherwise, re-determination is required to continue. This process is cycled until the reference sign of the desired concrete at the to-be-distributed location is determined to be the same as the reference sign of the concrete currently provided by the distribution device in the preset distribution area, so that the next to-be-distribution location is determined. Preferably, the preset distribution path planning rule may be to enable a path for distribution at remaining to-be-distributed locations in the preset distribution area to be shortest, or may be a preset sequence of the to-be-distributed locations in the preset distribution area. The sequence of all the to-be-distributed locations in the preset distribution area is set in advance, and when the distribution is completed at a certain to-be-distributed location, the next possible to-be-distributed location is determined according to the sequence set in advance.

Preferably, in the embodiment of the present invention, a material required to be distributed in the preset distribution area is concrete with the same reference sign, determining the to-be-distributed location in the preset distribution area includes determining the next to-be-distributed location according to the following formula: $BSR_{i+1}=BSR_i+\lambda\cdot\vec{\theta}\cdot\beta$, wherein $BSR_{i+1}$ is the next to-be-distributed location, $BSR_i$ is the current to-be-distributed location, $\lambda$ is a first preset proportion coefficient, $\beta$ is a real-time opening degree of a boom switch of the distribution device, and $\vec{\theta}$ is a direction of the boom switch. The direction of the boom switch determines a movement direction of a boom end, for example, the boom switch may be a universal switch; and the direction of the boom switch is a direction vector. Further, the direction of the boom switch may be in three-dimensional coordinates or in two-dimensional coordinates, which depends on the specific situations, and is not intended to limit the present invention.

Preferably, in the embodiment of the present invention, desired distribution time and a desired distribution volume may be determined according to a real-time opening degree of a pumping switch.

Specifically, a material required to be distributed in the preset distribution area is concrete with the same reference sign, when the distribution device is controlled to perform distribution at one to-be-distributed location in the preset distribution area, the desired distribution time for the to-be-distributed location is the opening duration of the pumping switch of the distribution device, and the desired distribution volume at the to-be-distributed location is determined based on the real-time opening degree of the pumping switch, the time corresponding to opening and closing in real time, and a second preset proportion coefficient. Specifically, the desired distribution volume is the opening duration of the pumping switch, and the opening duration of the pumping switch may be obtained by addition of time corresponding to real-time opening of the pumping degree, wherein the time corresponding to opening and closing in real time is the duration when the pumping switch is in the opening degree. The desired distribution volume may be determined based on accumulation of the product of each real-time opening degree and the time corresponding to the opening degree and then multiplying by the second preset proportion coefficient. For example, the real-time opening degree of the pumping switch is $\alpha_i$; the accumulated handle opening time is $$T=\sum_{\alpha_i>0}T_i,$$

a required distribution volume converted (desired distribution volume) is $$k_2\cdot\sum_{\alpha>0}\alpha_i\cdot T_i;$$

the desired distribution time is T; $k_2$ is the second preset proportion coefficient, which is preset in advance; and $T_i$ is the time corresponding to an ith real-time opening degree. Preferably, in the embodiment of the present invention, the time corresponding to each real-time opening degree is the same sampling period.

In addition, in the distribution process, obstacles in the process may also be avoided to guarantee the construction safety.

Preferably, in the embodiment of the present invention, after the next to-be-distributed location in the preset distribution area is determined, whether the current boom end location of the distribution device is the same as the next to-be-distributed location is judged. In the case that the current boom end location is different from the next to-be-distributed location, a next boom end location is planned. Whether there is an obstacle at the next boom end location is judged. In the case that there is an obstacle at the next boom end location, whether the obstacle is a person is judged. In the embodiment of the present invention, identification may be performed by machine vision, radar, or other ways, or advanced presetting may be performed according to construction scenarios. In the case that the obstacle is a person, the boom is controlled to stop movement until the obstacle is not a person or the next boom end location is clear of obstacles. In the case that the obstacle is not a person, the obstacle is avoided, a next boom end location is re-planned, until the boom end of the distribution device moves to the next to-be-distributed location, such that the distribution device performs the distribution for the next to-be-distributed location, wherein planning the next boom end location and re-planning the next boom end location satisfy any one of the following conditions: a distance from the next to-be-distributed location is shortest and a number of movement sections of the boom of the distribution device is least.

Preferably, in the embodiment of the present invention, the to-be-distributed locations in the preset distribution area are planned based on at least one of: a distance between the adjacent to-be-distributed locations is less than or equal to preset distribution interval, and the distance between the adjacent to-be-distributed locations is less than or equal to a distribution diameter of an end hose of the distribution device.

The pumping control method and the material distribution method provided by the embodiment of the present invention are exemplarily introduced below by taking the material being concrete as an example, wherein a control system, method, apparatus, and device are involved in the introduction.

There are diversified distribution scenarios of concrete, in some scenarios, certain pouring locations need to be fixed for distribution, and in some scenarios, continuous distribution is required, and the demands on different pouring locations are also different. The technical solution provided by the present invention can achieve automatic distribution under different construction demands.

Figure 8:
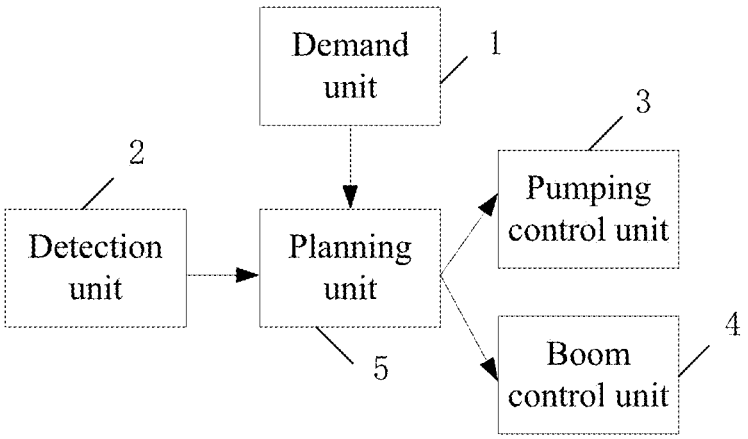
FIG. 8 is a structural block diagram of a control system provided by another embodiment of the present invention.

FIG. 8 is a structural block diagram of a control system provided by another embodiment of the present invention. As shown in FIG. 8, the control system includes a boom control unit 4, a pumping control unit 3, a planning unit 5, a detection unit 2 and a demand unit 1. The detection unit 2 obtains a current distribution status, such as a current boom end location, a completed distribution volume (equivalent to the real-time distribution volume in the embodiment of the present invention), distribution time (equivalent to the real-time distribution time in the embodiment of the present invention), a reference sign of concrete and an obstacle location, and outputs the current distribution status to the planning unit 5. The demand unit 1 obtains construction demands (including a construction location, a volume (equivalent to the desired distribution volume in the embodiment of the present invention), a required reference sign of concrete, time (equivalent to desired distribution time in the embodiment of the present invention), etc.) and a control command (e.g. a boom path planning mode, a distribution starting command, etc.). The planning unit 5 plans a boom movement location, a movement speed, a pumping speed, etc., at the next time according to the construction demands, the control command, and the current distribution status, and outputs to the boom control unit 4 and the pumping control unit 3. The pumping control unit 3 adjusts the pumping speed according to the requirements of the planning unit 5, and the boom control unit 4 adjusts the boom movement direction and speed according to the requirements of the planning unit 5.

In an embodiment of the present invention, the control system achieves automatic planning of fixed distribution and continuous transfer, improves the degree of operation automation of the device, more closely meets the construction demands, and alleviates the labor intensity of the operation of the device by virtue of the intelligent system.

The technical solution provided by the present invention is as follows: 1) the construction demands are decomposed into pouring locations which form a construction demand matrix, the specific construction is performed innovatively according to the pouring locations, the reference sign, the obstacles, the volume, the time, etc., and the boom movement path and the pumping speed are planned, which not only satisfies the diversified construction demands, but also guarantees the safety; 2) automatic and accurate synergistic control of the boom and the pumping is achieved, since automatic distribution is not only for the pouring locations but also for accurate pouring volume requirements; 3) an automatic grouped distribution method is proposed, which decomposes large construction requirements into smaller construction requirements that are easier to implement, simplifying the difficulty of automatic distribution; 4) an information flow of an automatic distribution-accurate pouring process is broken through to meet the precise demands of engineering construction and this process is automated and intelligent; and 5) a method of adjusting the movement track of the boom according to the type of obstacles is proposed, which does not adopt an obstacle avoidance mode in order to guarantee the safety of a person when the obstacle is the person.

1) Detection Unit

The detection unit may implement the following content. The current boom end location BSt(i) may be calculated by installing a dip angle sensor and a rotation angle sensor on each section of a boom, or can be detected directly by installation of a differential GPS on a boom end or other ways. The volume PC(i) of distribution that has been completed at the current pouring location, i.e., the real-time distribution volume in the embodiment of the present invention, can be calculated by the number of pumping times, the area of a pumping concrete cylinder, a piston stroke, suction conditions, etc., and the specific calculation method refers to the calculation method for the real-time distribution volume in the above embodiment. Time PT(i) for distribution which has been completed at the current pouring location can be calculated by an internal clock of an electronic device, etc, which is equivalent to the real-time distribution time in the embodiment of the present invention. The reference sign information PMt(i) of concrete which is pumped at present can be obtained from a concrete mixing station, a carrier vehicle, a pump, etc., by a communication or identification mode. Obstacle location and type can be identified by machine vision, radar, and other ways (related techniques have been widely applied in the unmanned field), or can be preset in advance according to construction scenarios.

2) Demand Unit

The demand unit may be one or more human-computer interaction units of a mobile phone, a PC, a remote controller, a display, etc., and implements construction demands and distribution mode settings via a human-machine interface or a switch button. The construction demands may be divided into one or more groups. Four examples of the demand unit are listed below.

In a first example, as shown in FIG. 9, construction demand tasks are decomposed into one group, the locations, volumes, reference signs, time or the like of different concrete pouring sites are set on the human-machine interface (pouring sites having different demands on the reference sign of concrete are mixed).

In a second example, as shown in FIG. 10, on the human-machine interface, different distribution areas, pouring time and volumes are set in a grouping manner according to the locations, reference signs and construction sequence of the pouring sites, pouring sites requiring the same reference sign of concrete are pertained to the same group (which can organize distribution on site more conveniently), and further the sequence of different pouring sites can be preset. Construction demands such as the locations, reference signs, volumes and time of different pouring sites are obtained according to set requirements.

In a third example, on the human-machine interface, the time and volume are set for a construction area requiring the same reference sign of concrete, without presetting pouring sites. As shown in FIG. 11, reference sign: C20, time: 50 M, and volume: 100 cubic meters, wherein time is the total time to complete distribution in the area shown in FIG. 11. The volume is a total volume after distribution is completed in the area shown in FIG. 11. The distribution area (as shown in a quadrangle in FIG. 11) is discretized into a plurality of closely distributed gridded pouring sites, and the pouring sites satisfy the following constraints: (1) a distance between the pouring sites is smaller than or equal to a set maximum distribution interval (equivalent to the preset distribution interval in the above embodiment, for example, the maximum distribution interval may be set to be XX cm); (2) the pouring sites are located in the distribution area; and (3) the distance between the pouring sites is smaller than or equal to an end hose distribution diameter. The goal of dividing the distribution area is to have a minimum number of pouring sites in the distribution area. Planning calculation is performed according to the above conditions to obtain the construction demands such as the location, reference sign, volume and time of each pouring site, and the required volume and time may be fixed values or may also be in an interval range, for example, after the pouring sites are planned, the required time and volume are calculated according to an area required to be covered by each pouring site.

In a fourth example, pouring sites are determined dynamically, time, a volume or the like of a next pouring site are determined in real time according to a boom switch and a pumping switch. A control device (for example, a remote controller) is configured to setting, and in a construction area requiring concrete with the same reference sign, an opening degree and direction of a control switch on the control device are discretized into locations, volumes and time of the pouring sites, and at the time, reference sign parameter of concrete is invariable. A conversion method is as follows: a discretized sampling period is $T_0$; a real-time opening degree of the pumping switch is $\alpha_i$; the accumulated opening time of a handle is $$T = \sum_{\alpha_i > 0} T_0,$$

a required pumping volume converted (desired distribution volume) equals to $$k_2 \cdot \sum_{\alpha_i > 0} \alpha_i \cdot T_0,$$

pumping time (desired distribution time) equals to T, $k_2$, is a second preset proportion coefficient which is preset in advance. A real-time opening of the boom switch is $\beta$, and a direction of the boom switch is $\vec{\theta}$, the location of the next pouring site is the current location $BSR_{i+1}=BSR_i+\lambda\cdot\vec{\theta}\cdot\beta$, and $\lambda$ is a first preset proportion coefficient which is preset in advance. That is, construction demands can be generated in real time by the pumping switch and the boom switch of the control apparatus. In the example, time corresponding to opening and closing in real time at each time is a sampling period T0

3) Planning Unit

1) Demand Analysis

The construction demands obtained by the demand unit are converted into a demand matrix with n pouring sites, and the pouring demand matrix is $$R = \begin{bmatrix} BSR_0 & \dots & BSR_n \\ PCR_0 & \dots & PCR_n \\ PMR_0 & \dots & PMR_n \\ PTR_0 & \dots & PTR_n \end{bmatrix}$$

wherein BSR is a location of a required pouring site, PCR is a required pouring volume, PMR is a required reference sign of concrete, PTR is required pouring time. There may be one or more demand matrices (one demand matrix corresponds to one group) according to the grouping condition of the demand unit, and of course, matrix dimensions may also be incremented and decreased according to actual construction demands (e.g. the reference sign of concrete is not considered, etc.).

2) Control Planning

A pumping speed $PV_{t(i)}$ at the current time point is calculated and a boom location BSt(i+1) at the next time point is planned according to the pouring demand matrix, a control command and a current distribution status.

(2.1) Pumping Speed Calculation (a) If the current location is at an ith pouring site, an initialized pumping speed is:

$$PV_{t(i)}=(PCR_i)/PTR_i \quad (1)$$

the pumping speed after dynamic adjustment is:

$$PV_{t(i)}=(PCR_i-PC(i))/(PTR_i-PT(i)) \quad (2).$$

That is, the initialized pumping speed is calculated according to the desired distribution volume and time at this pouring site, and the pumping speed is dynamically adjusted according to the actual completed distribution volume and time to guarantee that the distribution is completed according to the desired distribution volume and time. When distribution is completed at this pouring site, the pumping speed is 0.

(b) If the current location is not at the pouring site, the pumping speed is: $PV_{t(i)}=0$.

Whether the current location is at the pouring site is judged according to the relationship between a current boom end location and the pouring site, for example, $$ABS(BSt(i)-BSR_i)<\delta_{(i)} \quad (3)$$

wherein $\delta_{(i)}$ is a required deviation radius, which is given by the distance between the pouring sites and the end hose distribution radius, should be less than half of the distance of the adjacent pouring sites and the end hose distribution radius; BSt(i) represents the current boom end location and $BSR_i$ is a location of a pouring site in the pouring area.

(2.2) Boom Path Planning

After the distribution at the current pouring site is completed, that is the pumping speed equals to 0, the next pouring site is planned, two boom path planning modes are provided, and the next pouring site is calculated.

In a first mode, constraint conditions are as follows: a reference sign of concrete required by the next pouring site is the same as a reference sign of concrete provided by a current concrete transportation device, $PMR_{i+1}=PM_{t(i)}$, wherein $PM_{t(i)}$ is the reference sign of concrete provided by the current concrete transportation device; and a path to complete distribution at the remaining pouring sites is shortest, $$\text{Min}\left(\sum_{k=i}^{n} ABS(BSR_{i+1} - BSR_i)\right).$$

In a second mode, the distribution sequence of the pouring sites in the distribution area is preset in advance, the location of the next pouring site is a preset location, but at the same time, the reference sign of concrete satisfying the demand of the next pouring site is the same as the reference sign of concrete provided by the current concrete transportation device. When distribution is completed at all the pouring sites of the construction matrix, the planning for the next pouring site is stopped.

Figure 12:
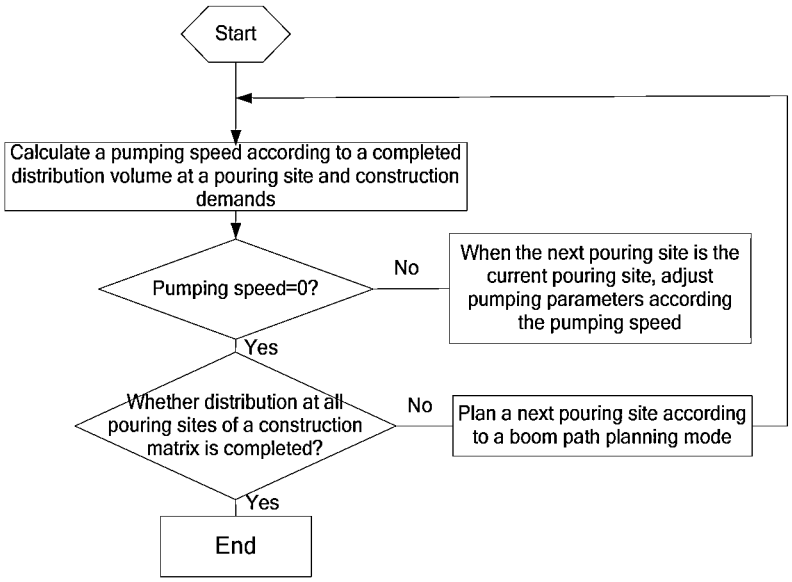
FIG. 12 is an overall planning flow chart of a next pouring location and a current pumping speed provided by another embodiment of the present invention.

The overall plan flow chart of the location of the next pouring site and the current pumping speed may refer to FIG. 12.

(2.3) Boom Location Calculation

Figure 13:
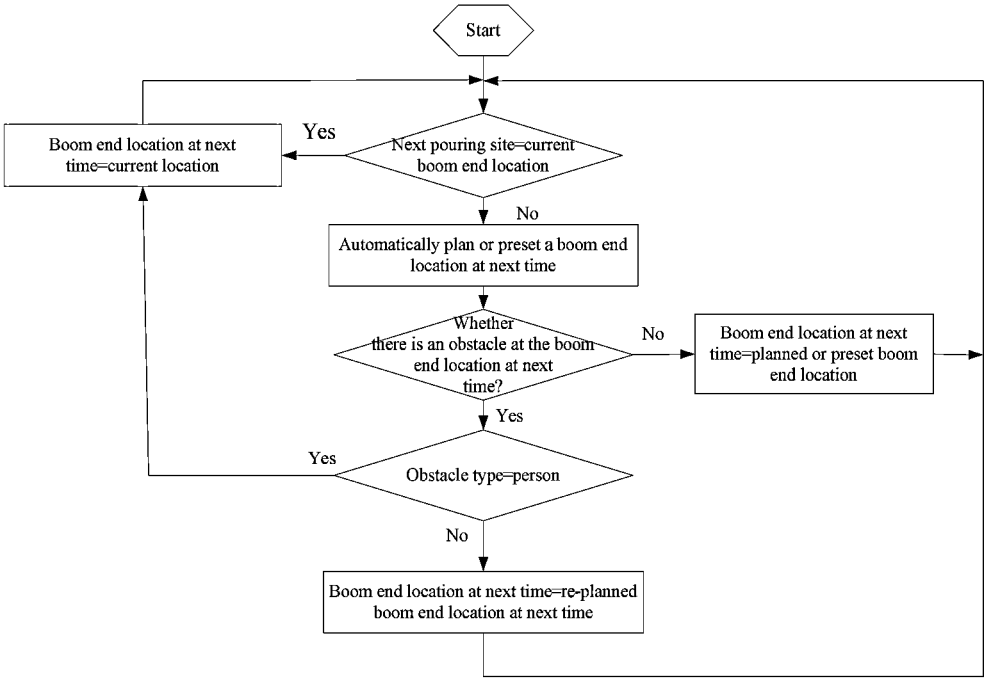
FIG. 13 is a logic flow diagram of calculation of a boom location at next time provided by another embodiment of the present invention.
Figure 14:
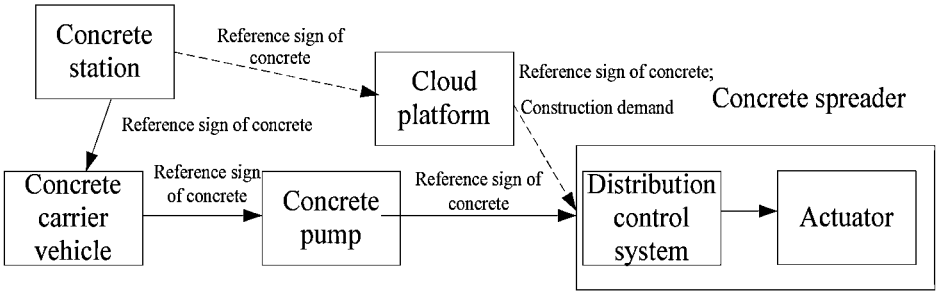
FIG. 14 is a schematic diagram of obtaining a reference sign of current concrete provided by another embodiment of the present invention.
Figure 15:
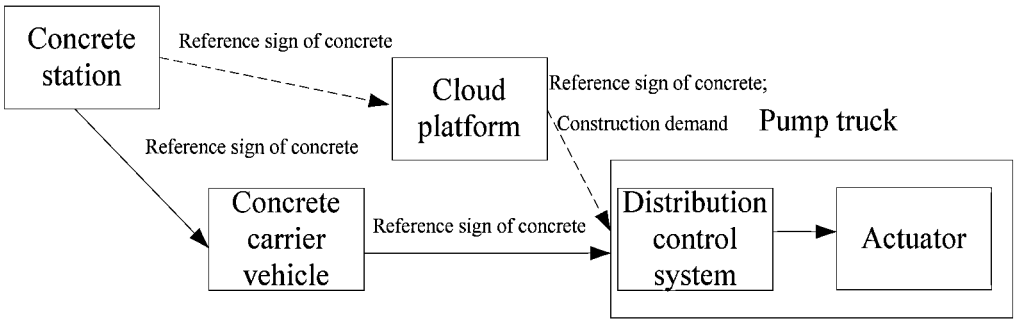
FIG. 15 is a schematic diagram of obtaining a reference sign of current concrete provided by another embodiment of the present invention.
Figure 16:
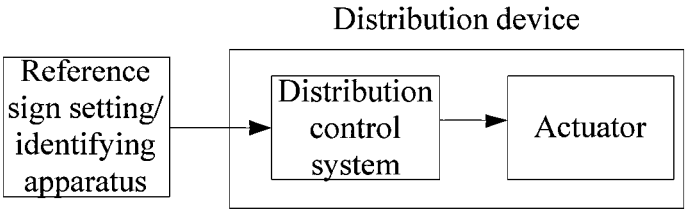
FIG. 16 is a schematic diagram of obtaining a reference sign of current concrete provided by another embodiment of the present invention.

The location of the next pouring site is planned from the above plan, and the boom location at next time can be calculated according to the current boom location, obstacle location and the location of the next pouring site, as shown in FIG. 13. Whether the location of the next pouring site is equal to the current boom end location is judged, if so, the boom end location at next time is equal to the current location, and if not, the boom end location at next time is automatically planned or preset. Whether there is an obstacle at the boom end location at next time is determined, if not, the boom end location at next time is equal to the boom end location which is automatically planned or preset, and if so, whether the obstacle is a person is judged. If the obstacle is a person, the boom stops movement, the boom end location at next time is equal to the current location, and then the above process continues to be performed circularly; and otherwise, the obstacle location is avoided, the boom end location at next time is re-planned, and then, the above process is repeated. When the boom end location at next time is calculated, (a1) the boom end location at next time equals to the current location, i.e., the boom stops movement, that is the current boom end location has been at the pouring site, or a person appears, the boom stops movement; (a2) the boom location at next time can be preset by the demand unit (that is, a movement path is set by the demand unit), or is planned automatically, and the planning method is as follows: a path from the location of the next pouring site is shortest, or a number of movement sections of the boom is least; and (a3) if there is an obstacle at the location at next time, the boom stops movement in order to guarantee the safety if the obstacle is a person, and the boom location at next time is re-planned according to the mode in (a2) based on the location of the obstacle if the obstacle is an object.

4) Boom Control Unit and Pumping Control Unit (1) According to the calculated pumping speed PVt(i), the pumping control unit implements an adjustment by controlling a main pump displacement and an engine speed.

(2) The boom control unit controls, according to the current boom end location BSt(i) and the boom end location BSt(i+1) at next time, and a difference value Ti(Ti=t(i+1)−t(i)) between the two time, a movement direction BDt(i) and a movement speed BVt(i) in a target direction of the boom, BDt(i)=BSt(i+1)−BSt(i), BVt(i)=ABS(BSt(i+1)−BSt(i))/Ti).

Furthermore, the embodiments of the present invention may be applied to a variety of concrete distribution device.

1) Concrete Spreader Device

The reference sign of the current concrete is obtained by a wired or wireless communication mode from a concrete pumping device or a cloud platform, and the construction demands are obtained by the cloud platform, and a distribution control system drives a corresponding actuator of the concrete spreader device to perform distribution.

2) Concrete Pump Truck Device

The reference sign of the current concrete is obtained by a wired or wireless communication mode from a concrete carrier vehicle or a cloud platform, and the construction demands are obtained by the cloud platform, and a distribution control system drives a corresponding actuator of a pumping device to perform distribution.

3) Distribution Device (e.g. a Pump Truck/Spreader, Etc.)

A reference sign of concrete is identified or set directly locally (e.g., by a machine vision identification mode or an artificial setting confirmation mode), and the construction demands (set by the demand unit of the distribution control system) are set.

Figure 17:
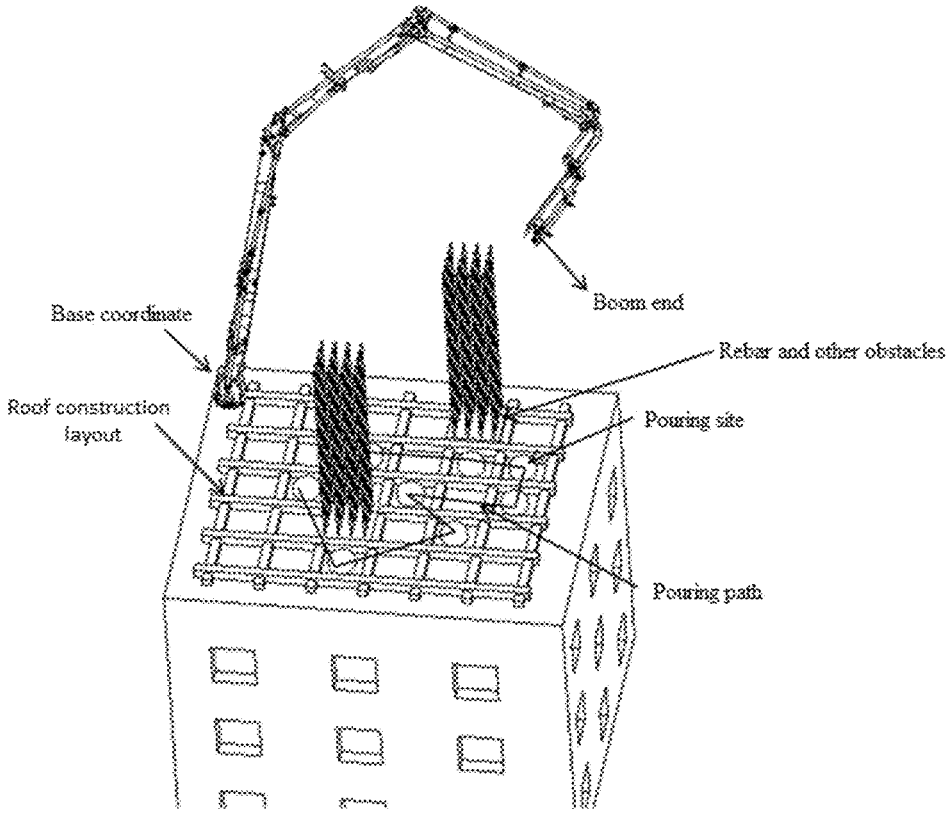
FIG. 17 is a schematic diagram of a construction scenario of a distribution machine provided by another embodiment of the present invention.

Further, the construction scenarios of the concrete spreader can refer to FIG. 17.

Compared with the prior art, the technical solution provided by the present invention has the following advantages: 1, the boom movement path can be planned automatically according to the specific demands such as the pouring location, reference signs, volumes and time, instead of just using a path presetting mode, and different distribution demands can be adapted; 2, it can be guaranteed that the distribution volume at each pouring site can satisfy the construction demands; 3, concrete with different reference signs can be prevented from pouring to an unmatched pouring site to avoid engineering quality problems; and 4, the boom can be prevented from touching the obstacle in the movement process to guarantee the construction safety.

Correspondingly, in an another aspect, an embodiment of the present invention also provides a pumping control apparatus.

Figure 18:
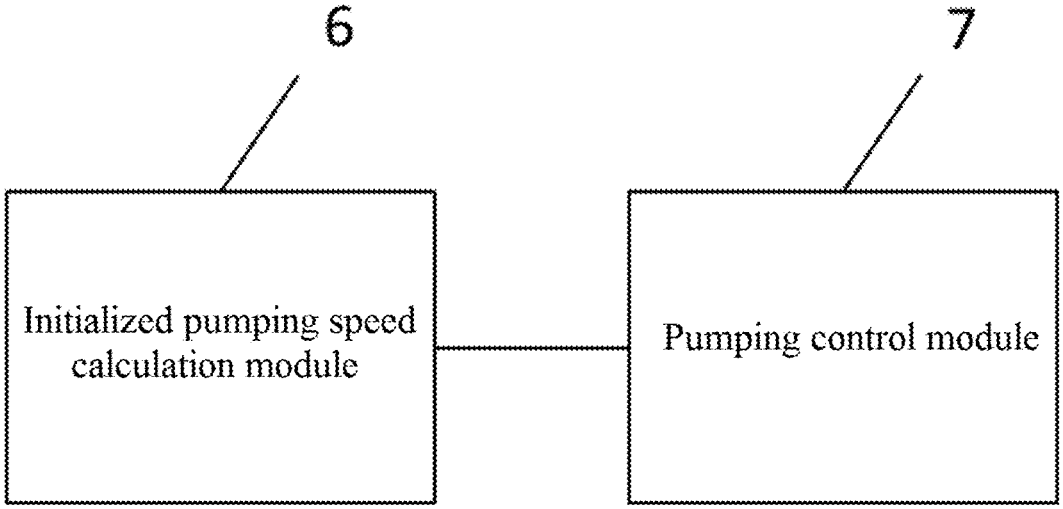
FIG. 18 is a structural schematic diagram of a pumping control apparatus provided by another embodiment of the present invention.

FIG. 18 is a structural schematic diagram of a pumping control apparatus provided by another embodiment of the present invention. As shown in FIG. 18, the pumping control apparatus includes an initialized pumping speed calculation module 6 and a pumping control module 7. The initialized pumping speed calculation module 6 is configured to calculating a initialized pumping speed according to a desired distribution volume and desired distribution time for a to-be-distributed location; and the pumping control module 7 is configured to controlling a distribution device to pump at the initialized pumping speed and dynamically adjusting a pumping speed of the distribution device in real time according to a completed real-time distribution volume and real-time distribution time during the pumping of the distribution device until the real-time distribution volume is the desired distribution volume.

Preferably, in the embodiment of the present invention, the real-time distribution volume is determined according to an area of a pumping concrete cylinder and an effective stroke of a piston in pumping at each time.

Preferably, in the embodiment of the present invention, the real-time distribution volume is determined by: multiplying a number of pumping times, the area of the pumping concrete cylinder, and an average value of the effective stroke of the piston in pumping at each time; or determining a distribution volume in pumping at each time based on the area of the pumping concrete cylinder and the effective stroke of the piston in pumping at each time, and accumulating the distribution volume in pumping at each time.

Preferably, in the embodiment of the present invention, the effective stroke of the piston in pumping at each time is determined based on: time when the piston starts to move in pumping at this time, time when a pumping pressure reaches a stable value, time when pumping is completed, and a theoretical stroke of the piston.

Preferably, in the embodiment of the present invention, the effective stroke of the piston in pumping at each time is determined based on: an actual stroke of the piston from the start of pumping to the pumping pressure reaching the stable value during pumping at this time, an actual stroke from the pumping pressure reaching the stable value to the end of pumping during pumping at this time, and a preset suction coefficient.

Preferably, in the embodiment of the present invention, the real-time distribution volume is determined according to a real-time discharge volume of an agitator truck for providing a material for the distribution device.

The specific working principles and benefits of the pumping control apparatus provided by the embodiment of the present invention are similar to those of the pumping control method provided by the embodiment of the present invention and will not be described in detail herein.

Accordingly, in another aspect, an embodiment of the present invention also provides a material distribution apparatus, including: a distribution control module configured to control a distribution device to perform distribution at a to-be-distributed location in a preset distribution area, and after distribution is completed at the to-be-distributed location, determine a next to-be-distributed location and performing distribution at the next to-be-distributed location until distribution at each to-be-distributed location in the preset distribution area is completed, wherein a material required to be distributed at the next to-be-distributed location and a material currently provided by the distribution device are concrete with the same reference sign, and distribution is performed at each to-be-distributed location in the preset distribution area according to the pumping control method in the embodiment of the present invention.

Preferably, in the embodiment of the present invention, the determining the next to-be-distributed location in the preset distribution area comprising: determining a to-be-distributed location in the preset distribution area based on a preset distribution path planning rule; judging whether a reference sign of desired concrete at the determined to-be-distributed location is the same as a reference sign of concrete currently provided by the distribution device; and in the case that the reference sign of the desired concrete at the determined to-be-distributed location is different from the reference sign of the concrete provided by the distribution device, re-determining a to-be-distributed location in the preset distribution area based on the preset distribution path planning rule, until the reference sign of the desired concrete at the determined to-be-distributed location is the same as the reference sign of the concrete currently provided by the distribution device, wherein the determined to-be-distributed location is the next to-be-distributed location.

Preferably, in the embodiment of the present invention, the preset distribution path planning rule is:

such that a path for distribution completed at remaining to-be-distributed locations in the preset distribution area is shortest; or a preset sequence of the to-be-distributed locations in the preset distribution area.

Preferably, in the embodiment of the present invention, a material required to be distributed in the preset distribution area is concrete with the same reference sign, and the determining the next to-be-distributed location in the preset distribution area comprises determining the next to-be-distributed location according to the following formula: $BSR_{i+1}=BSR_i+\lambda\cdot\vec{\theta}\cdot\beta$, wherein $BSR_{i+1}$ is the next to-be-distributed location, $BSR_i$ is a current to-be-distributed location, $\lambda$ is a first preset proportion coefficient, $\beta$ is a real-time opening degree of a boom switch of the distribution device, and $\vec{\theta}$ is a direction of the boom switch.

Preferably, in the embodiment of the present invention, a material required to be distributed in the preset distribution area is concrete with the same reference sign, when the distribution device is controlled to perform distribution at one to-be-distributed location in the preset distribution area, desired distribution time for this to-be-distributed location is an opening duration of a pumping switch of the distribution device, and a desired distribution volume at this to-be-distributed location is determined based on the real-time opening degree of the pumping switch, time corresponding to opening and closing in real time, and a second preset proportion coefficient.

Preferably, in the embodiment of the present invention, after determining the next to-be-distributed location in the preset distribution area, the distribution apparatus further comprising: a judgment module configured to judge whether a current boom end location of the distribution device is the same as the next to-be-distributed location after the next to-be-distributed location in the preset distribution area is determined; a planning module configured to plan a next boom end location in the case that the current boom end location is different from the next to-be-distributed location; the judgment module further configured to: judge whether there is an obstacle at the next boom end location, and judge whether the obstacle is a person in the case that there is the obstacle at the next boom end location; the distribution apparatus further comprising: in the case that the obstacle is a person, controlling a boom to stop movement until the obstacle is not a person or the next boom end location is clear of an obstacle; and the planning module is further configured to: in the case that the obstacle is not a person, avoid the obstacle, re-planning a next boom end location until a boom end of the distribution device moves to the next to-be-distributed location such that the distribution device performs distribution at the next to-be-distributed location, wherein the planning the next boom end location and re-planning the next boom end location satisfy any one of the following conditions: a distance from the next to-be-distributed location is shortest and a number of movement sections of the boom of the distribution device is least.

Preferably, in the embodiment of the present invention, the to-be-distributed location in the preset distribution area is planned based on at least one of: a distance between the adjacent to-be-distributed locations is less than or equal to a preset distribution interval, and the distance between the adjacent to-be-distributed locations is less than or equal to a distribution diameter of an end hose of the distribution device.

In addition, in another aspect, an embodiment of the present invention provides a distribution device including: the pumping control apparatus in the above embodiment; and/or the distribution apparatus in the above embodiment.

The preferred embodiments of the present invention are described above in detail with reference to the accompanying drawings, but the present invention is not limited to the specific details in the above embodiments, multiple simple modifications may be made to the technical solutions of the present invention within the technical concept of the present invention, and these simple modifications fall within the scope of protection of the present invention.

Furthermore, it should be noted that various specific technical features described in the above specific embodiments may be combined in any suitable manner in the case of no confliction. In order to avoid unnecessary repetition, various possible combinations are not further described in the present invention.

In addition, optional combination between the various different embodiments of the present invention is also possible as long as it does not depart from the concept of the present invention and should likewise be considered as the disclosure of the present invention.

The invention claimed is:

1. A pumping control method for controlling pumping speed of a concrete distribution device, comprising calculating an initialized pumping speed according to a desired distribution volume and desired distribution time for a to-be-distributed location;

controlling the concrete distribution device to pump at the initialized pumping speed; and dynamically adjusting the pumping speed of the concrete distribution device in real time according to a completed real-time distribution volume and real-time distribution time during pumping of the concrete distribution device until the completed real-time distribution volume is the desired distribution volume, wherein the completed real-time distribution volume is determined according to an area of a pumping concrete cylinder and an effective stroke of a piston in each pumping action, wherein the effective stroke of the piston in the each pumping action is determined based on: an actual stroke of the piston from the start of pumping to the pumping pressure reaching the stable value during the each pumping action, an actual stroke from the pumping pressure reaching the stable value to the end of pumping during the each pumping action, and a preset suction coefficient.

2. The pumping control method according to claim 1, wherein the completed real-time distribution volume is determined by multiplying a number of pumping actions, the area of the pumping concrete cylinder, and an average value of the effective stroke of the piston in the each pumping action; or determining a distribution volume in the each pumping action based on the area of the pumping concrete cylinder and the effective stroke of the piston in the each pumping action, and accumulating the distribution volume in the each pumping action.

3. The pumping control method according to claim 1, wherein the effective stroke of the piston in the each pumping action is determined based on: time when the piston starts to move in the each pumping action, time when a pumping pressure reaches a stable value, time when pumping is completed, and a theoretical stroke of the piston.

4. The pumping control method according to claim 1, wherein the real-time distribution volume is approximately equal to a real-time discharge volume of an agitator truck for providing a concrete for the concrete distribution device.

5. A material distribution method for controlling pumping speed of a concrete distribution device, comprising:

controlling the concrete distribution device to perform distribution at a to-be-distributed location in a preset distribution area; and after distribution at the to-be-distributed location is completed, determining a next to-be-distributed location in the preset distribution area and performing distribution at the next to-be-distributed location until distribution at each to-be-distributed location in the preset distribution area is completed, wherein a material required to be distributed at the next to-be-distributed location and a material currently provided by the concrete distribution device are concrete with the same reference sign, and distribution is performed at each to-be-distributed location in the preset distribution area by the pumping control method according to claim 1.

6. The material distribution method according to claim 5, wherein the determining the next to-be-distributed location in the preset distribution area comprising:

determining a to-be-distributed location in the preset distribution area based on a preset distribution path planning rule;

judging whether a reference sign of desired concrete at the determined to-be-distributed location is the same as a reference sign of concrete currently provided by the concrete distribution device; and in the case that the reference sign of the desired concrete at the determined to-be-distributed location is different from the reference sign of the concrete provided by the concrete distribution device, re-determining a to-be-distributed location in the preset distribution area based on the preset distribution path planning rule, until the reference sign of the desired concrete at the determined to-be-distributed location is the same as the reference sign of the concrete currently provided by the concrete distribution device, wherein the determined to-be-distributed location is the next to-be-distributed location.

7. The material distribution method according to claim 6, wherein the preset distribution path planning rule is:

such that a path for distribution completed at remaining to-be-distributed locations in the preset distribution area is shortest; or a preset sequence of the to-be-distributed locations in the preset distribution area.

8. The material distribution method according to claim 5, wherein a material required to be distributed in the preset distribution area is concrete with the same reference sign, and the determining the next to-be-distributed location in the preset distribution area comprises determining the next to-be-distributed location according to the following formula:

$$BSR_{i+1}=BSR_i+\lambda\cdot\vec{\theta}\cdot\beta$$

wherein $BSR_{i+1}$ is the next to-be-distributed location, $BSR_i$ is a current to-be-distributed location, $\lambda$ is a first preset proportion coefficient, $\beta$ is a real-time opening degree of a boom switch of the concrete distribution device, and $\vec{\theta}$ is a direction of the boom switch.

9. The material distribution method according to claim 5, wherein a material required to be distributed in the preset distribution area is concrete with the same reference sign, when the concrete distribution device is controlled to perform distribution at one to-be-distributed location in the preset distribution area, desired distribution time for this to-be-distributed location is an opening duration of a pumping switch of the concrete distribution device, and a desired distribution volume at this to-be-distributed location is determined based on the real-time opening degree of the pumping switch, time corresponding to opening and closing in real time, and a second preset proportion coefficient.

10. The material distribution method according to claim 5, after determining the next to-be-distributed location in the preset distribution area, the distribution method further comprising:

judging whether a current boom end location of the concrete distribution device is the same as the next to-be-distributed location;

planning a next boom end location in the case that the current boom end location is different from the next to-be-distributed location;

judging whether there is an obstacle at the next boom end location;

judging whether the obstacle is a person in the case that there is the obstacle at the next boom end location;

in the case that the obstacle is a person, controlling a boom to stop movement until the obstacle is not a person or the next boom end location is clear of an obstacle; and in the case that the obstacle is not a person, avoiding the obstacle, re-planning a next boom end location until a boom end of the concrete distribution device moves to the next to-be-distributed location such that the concrete distribution device performs distribution at the next to-be-distributed location, wherein the planning the next boom end location and re-planning the next boom end location satisfy any one of the following conditions: a distance from the next to-be-distributed location is shortest and a number of movement sections of the boom of the concrete distribution device is least.

11. The material distribution method according to claim 5, wherein the to-be-distributed location in the preset distribution area is planned based on at least one of: a distance between the adjacent to-be-distributed locations is less than or equal to a preset distribution interval, and the distance between the adjacent to-be-distributed locations is less than or equal to a distribution diameter of an end hose of the concrete distribution device.

12. The material distribution method according to claim 5, wherein the completed real-time distribution volume is determined according to an area of a pumping concrete cylinder and an effective stroke of a piston in each pumping action.

13. The material distribution method according to claim 12, wherein the completed real-time distribution volume is determined by:

multiplying a number of pumping actions, the area of the pumping concrete cylinder, and an average value of the effective stroke of the piston in the each pumping action; or determining a distribution volume in the each pumping action based on the area of the pumping concrete cylinder and the effective stroke of the piston in the each pumping action, and accumulating the distribution volume in the each pumping action.

14. The material distribution method according to claim 12, wherein the effective stroke of the piston in the each pumping action is determined based on: time when the piston starts to move in the each pumping action, time when a pumping pressure reaches a stable value, time when pumping is completed, and a theoretical stroke of the piston.

15. The material distribution method according to claim 5, wherein the real-time distribution volume is approximately equal to a real-time discharge volume of an agitator truck for providing a concrete for the concrete distribution device.

16. A pumping control apparatus for controlling pumping speed of a concrete distribution device, comprising:

an initialized pumping speed calculation module configured to calculate an initialized pumping speed according to a desired distribution volume and desired distribution time for a to-be-distributed location; and a pumping control module configured to:

control the concrete distribution device to pump at the initialized pumping speed; and dynamically adjust the pumping speed of the concrete distribution device in real time according to a completed real-time distribution volume and real-time distribution time during pumping of the concrete distribution device until the completed real-time distribution volume is the desired distribution volume, wherein the completed real-time distribution volume is determined according to an area of a pumping concrete cylinder and an effective stroke of a piston in each pumping action, wherein the effective stroke of the piston in the each pumping action is determined based on: an actual stroke of the piston from the start of pumping to the pumping pressure reaching the stable value during the each pumping action, an actual stroke from the pumping pressure reaching the stable value to the end of pumping during the each pumping action, and a preset suction coefficient.

17. The pumping control apparatus according to claim 16, wherein the completed real-time distribution volume is determined by:

multiplying a number of pumping actions, the area of the pumping concrete cylinder, and an average value of the effective stroke of the piston in the each pumping action; or determining a distribution volume in the each pumping action based on the area of the pumping concrete cylinder and the effective stroke of the piston in the each pumping action, and accumulating the distribution volume in the each pumping action.

18. The pumping control apparatus according to claim 16, wherein the effective stroke of the piston in the each pumping action is determined based on: time when the piston starts to move in the each pumping action, time when a pumping pressure reaches a stable value, time when pumping is completed, and a theoretical stroke of the piston.

19. The pumping control apparatus according to claim 16, wherein the real-time distribution volume is approximately equal to a real-time discharge volume of an agitator truck for providing a concrete for the concrete distribution device.

20. A material distribution apparatus for controlling pumping speed of a concrete distribution device, comprising:

a distribution control module configured to:

control the concrete distribution device to perform distribution at a to-be-distributed location in a preset distribution area; and after distribution at the to-be-distributed location is completed, determine a next to-be-distributed location in the preset distribution area and perform distribution at the next to-be-distributed location, until distribution at each to-be-distributed location in the preset distribution area is completed, wherein a material required to be distributed at the next to-be-distributed location and a material currently provided by the concrete distribution device are concrete with the same reference sign, and distribution is performed at each to-be-distributed location in the preset distribution area by the pumping control method according to claim 1.

21. The material distribution apparatus according to claim 20, wherein the determining the next to-be-distributed location in the preset distribution area comprising:

determining a to-be-distributed location in the preset distribution area based on a preset distribution path planning rule;

judging whether a reference sign of desired concrete at the determined to-be-distributed location is the same as a reference sign of concrete currently provided by the concrete distribution device; and in the case that the reference sign of the desired concrete at the determined to-be-distributed location is different from the reference sign of the concrete provided by the concrete distribution device, re-determining a to-be-distributed location in the preset distribution area based on the preset distribution path planning rule, until the reference sign of the desired concrete at the determined to-be-distributed location is the same as the reference sign of the concrete currently provided by the concrete distribution device, wherein the determined to-be-distributed location is the next to-be-distributed location.

22. The material distribution apparatus according to claim 21, wherein the preset distribution path planning rule is:

such that a path for distribution completed at remaining to-be-distributed locations in the preset distribution area is shortest; or a preset sequence of the to-be-distributed locations in the preset distribution area.

23. The material distribution apparatus according to claim 20, wherein a material required to be distributed in the preset distribution area is concrete with the same reference sign, and the determining the next to-be-distributed location in the preset distribution area comprises determining the next to-be-distributed location according to the following formula:

$$BSR_{i+1}=BSR_i+\lambda\cdot\vec{\theta}\cdot\beta$$

wherein $BSR_{i+1}$ is the next to-be-distributed location, $BSR_i$ is a current to-be-distributed location, $\lambda$ is a first preset proportion coefficient, $\beta$ is a real-time opening degree of a boom switch of the concrete distribution device, and $\vec{\theta}$ is a direction of the boom switch.

24. The material distribution apparatus according to claim 20, wherein a material required to be distributed in the preset distribution area is concrete with the same reference sign, when the concrete distribution device is controlled to perform distribution at one to-be-distributed location in the preset distribution area, desired distribution time for this to-be-distributed location is an opening duration of a pumping switch of the concrete distribution device, and a desired distribution volume at this to-be-distributed location is determined based on the real-time opening degree of the pumping switch, time corresponding to opening and closing in real time, and a second preset proportion coefficient.

25. The material distribution apparatus according to claim 20, after determining the next to-be-distributed location in the preset distribution area, the distribution apparatus further comprising:

a judgment module configured to judge whether a current boom end location of the concrete distribution device is the same as the next to-be-distributed location after the next to-be-distributed location in the preset distribution area is determined;

a planning module configured to plan a next boom end location in the case that the current boom end location is different from the next to-be-distributed location;

the judgment module further configured to:

judge whether there is an obstacle at the next boom end location, and judge whether the obstacle is a person in the case that there is the obstacle at the next boom end location;

the distribution apparatus further comprising: in the case that the obstacle is a person, controlling a boom to stop movement until the obstacle is not a person or the next boom end location is clear of an obstacle; and the planning module is further configured to: in the case that the obstacle is not a person, avoid the obstacle, re-planning a next boom end location until a boom end of the concrete distribution device moves to the next to-be-distributed location such that the concrete distribution device performs distribution at the next to-be-distributed location, wherein the planning the next boom end location and re-planning the next boom end location satisfy any one of the following conditions: a distance from the next to-be-distributed location is shortest and a number of movement sections of the boom of the concrete distribution device is least.

26. The material distribution apparatus according to claim 20, wherein the to-be-distributed location in the preset distribution area is planned based on at least one of: a distance between the adjacent to-be-distributed locations is less than or equal to a preset distribution interval, and the distance between the adjacent to-be-distributed locations is less than or equal to a distribution diameter of an end hose of the concrete distribution device.

27. The material distribution apparatus according to claim 20, wherein the completed real-time distribution volume is determined according to an area of a pumping concrete cylinder and an effective stroke of a piston in each pumping action.

28. The material distribution apparatus according to claim 27, wherein the completed real-time distribution volume is determined by:

multiplying a number of pumping actions, the area of the pumping concrete cylinder, and an average value of the effective stroke of the piston in the each pumping action, or determining a distribution volume in the each pumping action based on the area of the pumping concrete cylinder and the effective stroke of the piston in the each pumping action, and accumulating the distribution volume in the each pumping action.

29. The material distribution apparatus according to claim 27, wherein the effective stroke of the piston in the each pumping action is determined based on: time when the piston starts to move in the each pumping action, time when a pumping pressure reaches a stable value, time when pumping is completed, and a theoretical stroke of the piston.

30. The material distribution apparatus according to claim 20, wherein the real-time distribution volume is approximately equal to a real-time discharge volume of an agitator truck for providing a concrete for the concrete distribution device.

* * * * *